US005263588A

United States Patent [19]

Bryde

[11] Patent Number: 5,263,588

[45] Date of Patent: Nov. 23, 1993

[54] SORTING TRAY

[76] Inventor: John K. Bryde, 15526 - 98A Avenue, Surrey, British Columbia, Canada, V3R 8X6

[21] Appl. No.: 824,145

[22] Filed: Jan. 22, 1992

[51] Int. Cl.[5] ..... B65D 6/04

[52] U.S. Cl. ..... 206/564; 206/449; 206/455; 211/10

[58] Field of Search ..... 40/124, 124.2, 124.4; 206/425, 454, 455, 456, 555, 557, 558, 561, 564, 565, 449; 211/10, 50

[56] References Cited

U.S. PATENT DOCUMENTS

| | | | |
|---|---|---|---|
| 1,333,231 | 3/1920 | Ulrich | 206/425 |
| 1,659,509 | 2/1928 | Ashbrook | 206/564 |
| 1,699,025 | 1/1929 | Schulz | 206/564 |
| 2,016,009 | 10/1935 | Johnson et al. | 206/564 |
| 2,520,490 | 8/1950 | Boward | 273/150 |
| 2,631,042 | 3/1953 | Bertram | 273/148 |
| 2,964,195 | 12/1960 | Valis | 206/425 |
| 4,001,952 | 3/1977 | Smith | 211/10 |
| 4,164,309 | 8/1979 | Staats | 206/425 |
| 4,170,303 | 10/1979 | Nolan | 206/557 |
| 4,634,125 | 1/1987 | Seklecki | 273/93 R |

FOREIGN PATENT DOCUMENTS

| | | | |
|---|---|---|---|
| 0286952 | 12/1966 | Australia | 206/456 |
| 0566747 | 9/1975 | Switzerland | 206/456 |
| 1085414 | 10/1967 | United Kingdom | 206/454 |
| 2182018 | 5/1987 | United Kingdom | 206/507 |

OTHER PUBLICATIONS

Card-Well-advertisement, Jul. 1991 issue Tuff Stuff.

Pro-Super-Sorter-advertised in the Jul. 5, 1991 issue of Sports Collector's Digest.

*Primary Examiner*—Jimmy G. Foster

*Attorney, Agent, or Firm*—Norman M. Cameron

[57] ABSTRACT

A sorting tray having a plurality of adjacent bins. Each of the bins has a front, a back and a bottom. Each bin is v-shaped with inclined sides diverging upwardly from the bottom thereof. Preferably the sorting tray includes recesses for protecting corners of cards placed or dropped in each bin.

1 Claim, 2 Drawing Sheets

SORTING TRAY

BACKGROUND OF THE INVENTION

1. Field of the Invention

This invention relates to sorting trays, in particular the type which include a plurality of bins for sorting cards, such as sports cards, into different categories.

2. Description of Related Art

Collecting sports cards, such as baseball cards, football cards or hockey cards has become a widespread hobby and business. There are many occasions when collectors or sellers of cards wish to arrange them into specific categories, such as numerical sequences, according to the teams, players and the like. At the same time, it is essential that the condition of the cards is well protected during the sorting process. Some cards are extremely valuable and even a slightly damaged corner can affect their selling price.

Sorting trays which include a plurality of rectangular bins for holding stacks of cards have been marketed including ones sold under the trademarks CARDWELL and PRO SUPERSORTER. These devices predating the invention do not include any provision for protecting the corners of cards however. They are also slower and more difficult to use then desired. CARDWELL trays have 20 bins which slope towards the person using the product and 4 additional bins where the cards stack vertically. PRO SUPERSORTER trays have 28 bins which slope towards their fronts.

U.S. Pat. No. 2,520,490 to Boward shows a curved holder for displaying cards. It does not include bins for sorting cards however.

A manual sorter for sheets is shown in U.S. Pat. No. 4,001,952 to Smith. It includes separate bins for different stacks of sheets.

U.S. Pat. No. 2,631,042 to Bertram shows a playing card holder with angled bins.

A picture frame specially intended for displaying sports cards is shown in the U.S. Pat. No. 4,170,303 to Nolan. It has no sorting function however.

U.S. Pat. No. 4,634,125 to Seklecki describes a device and method for storing and dispensing trading cards. Card dispensing tray 30 is shown in FIGS. 2 and 3.

SUMMARY OF THE INVENTION

The invention provides a sorting tray comprising a plurality of adjacent bins. Each of the bins has a front, a back and a bottom. Each bin is v-shaped with inclined sides which diverge upwardly from the bottom thereof.

Preferably, the bins are angled downwardly towards the fronts thereof.

Each of the bins may include means for protecting corners of cards placed in each bin. The means may include a recess along each side of each bin adjacent to the front thereof. The means may also include a recess on the front of each bin near the bottom thereof. The means for protecting corners may further include a raised area on the front of each bin above the recess and inclined areas extending from the raised area to the sides of the bin on each side of the recess.

Sorting trays according to the invention are designed for optimal sorting efficiency of boxes of 540 randomly sequenced cards into numerical order according to the unique 1, 2 or 3 digit number on the back of each card. Thus the invention increases the speed and ease of sorting as well as the function of protecting the corners of cards.

DESCRIPTION OF THE PREFERRED EMBODIMENTS

Figure 1:
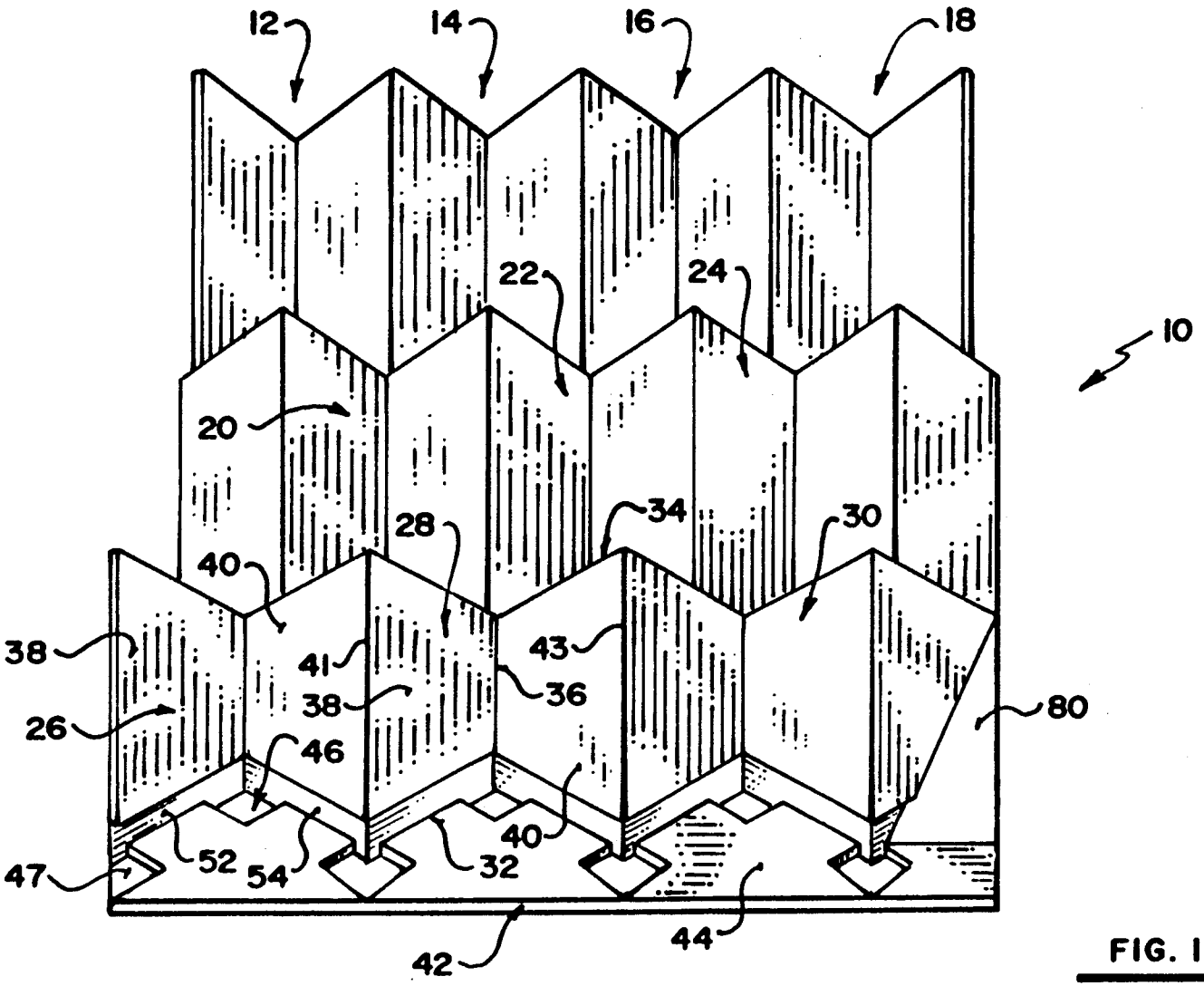
FIG. 1 is a top perspective view of a sorting tray according to an embodiment of the invention.
Figure 2:
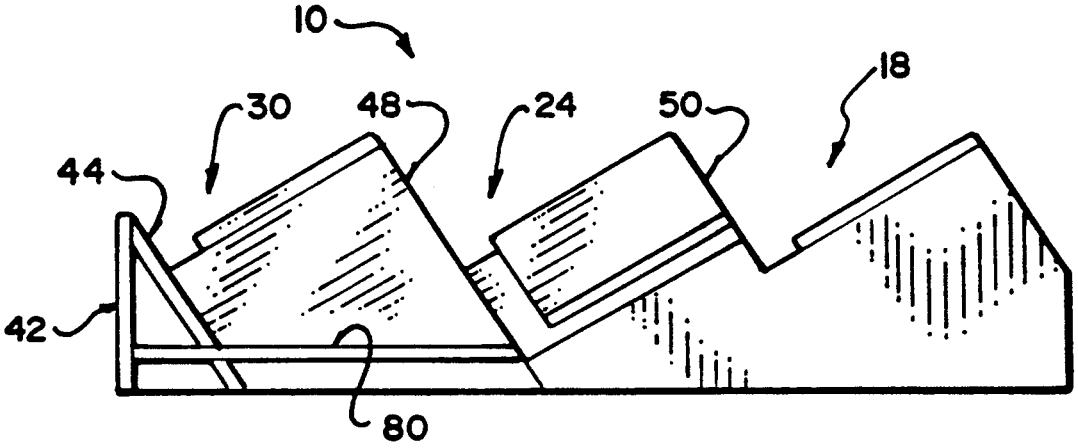
FIG. 2 is a side elevation thereof.

FIGS. 1 and 2 illustrate a sorting tray 10 according to a first embodiment of the invention which normally lies flat in a horizontal plane in use. The illustrated embodiment is cut and formed from corrugated plastic panels although alternatively it could be made of cardboard or formed thermally from a single plastic sheet or from plastic resin injected into a mold. Many of the illustrated corners could be rounded. Rounded corners protect card edges and corners from damage. In this example the tray is roughly 15" square and 3" high though these dimensions can be varied.

Sorter 10 includes ten bins, including bins 12, 14, 16 and 18 arranged adjacently to form a back row of four bins, bins 20, 22 and 24 forming a middle row of three bins and bins 26, 28 and 30 forming a front row of three bins. It should be understood that many other configurations or numbers of bins are possible in other examples of the invention. The number of rows can be changed as can the number of bins in each row. Other possible configurations of numbers of bins in each of three rows are four, three, and four or three, three and four. In addition, the bins need not be arranged in rows at all. In one alternative embodiment the bins are arranged in a single curved row.

Each bin, for example bin 28, is v-shaped, having a front 32, a ridge-like back 34 and a valley-like bottom 36. Each bin has two sides 38 and 40 which are both rectangular in this embodiment although they appear otherwise because of the perspective view of FIG. 1. The sides are symmetrical in this example so right handed persons can pile cards on the right sides and left handed people on the left sides, but this is not essential. The sides diverge upwardly from the bottom of each bin to peaks 41 and 43 at an angle of 90 degrees in this example, although this is not critical. This forms the v-shape of each bin. The front 32 is generally perpendicular to the sides 38 and 40 which are generally perpendicular to each other.

The bins are generally $2\frac{1}{2}'' \times 3\frac{1}{2}''$ for this embodiment intended for sports cards. The bins are slightly narrower than the cards. If too narrow, the landing space for the cards is too small and the cards may not fall neatly into the correct pile. If too wide the card pile cannot be quickly and easily retrieved from the bin because they can't be grasped by their overhanging edges. The bins are slightly higher than the cards so the tops of cards in front rows won't interfere with the bottoms of cards in the back rows. Other sizes of bins could be used for sorting such things as invoices, credit cards, credit card slips by credit card number, business cards by postal code, photographs by the date and the like. The bins are shaped so labels can easily be affixed according to the sorting function and are still partially visible when the bins are half full.

As may be seen the best in FIG. 2 for bins 18, 24 and 30, the bins are angled downwardly towards the fronts thereof. In this embodiment an angle of 30 degrees–45 degrees is preferred. When cards are placed in the bins, they are piled on top of each other to form a stack parallel to one of the sides of the bin. One side of the stack rests against the other side of the bin. Alternatively, the bins could be angled downwardly towards their backs. The bins are preferably angled 10 degrees–15 degrees in this case.

Sorter 10 has a front panel 42 having an inclined back surface 44 which forms the fronts of bins 26, 28 and 30. The backs of the bins in the front and middle rows form the fronts of the bins in the back two rows respectively. For example, as seen in FIG. 2, back 48 of bin 30 forms the front of bin 24, while back 50 of bin 24 forms the front of bin 18. It may be observed from FIG. 1 that the bottoms of the bins in adjacent rows are staggered by a half bin width to permit the backs of the two front rows of bins to form the fronts of the two back rows. Staggering is not essential, but helps fit the ten bins into a compact shape.

Each of the bins in sorter 10 includes means for protecting corners of cards placed in the bins although the means is illustrated only for bins 26, 28 and 30 in the front row. This means includes a recess 52 extending along the front side 38 of each bin and a similar recess 54 along the front of side 40 of each bin as seen in bin 26. Alternatively the means may be viewed as the raised portion of each side extending rearwardly from the recess on the front of each side of the bin. Thus it may be seen that inside front corners of cards in a stack within the bin cannot contact either side of the bin because the stack is supported by the sides of the bin rearwardly of the corners of the cards only.

Each of the bins in FIGS. 1 and 2 has additional means for protecting corners of the cards which includes a recess 46 in the front of each bin as illustrated for bin 26. This recess is adjacent to the bottom of the bin and is generally square in this embodiment although this is not critical. Thus the fronts of the cards contact the fronts of the bins only above their corners, at least until the stack of cards is higher than recess 46 along one of the sides of the bin. There are additional such recesses 47 and 49 to each side at the tops of the bins. When cards are piled on the right side of the bin, recess 49 protects the bottom right corner of the cards. When cards are piled on the left side, recess 47 protects the bottom left corner of the cards.

Figure 3:
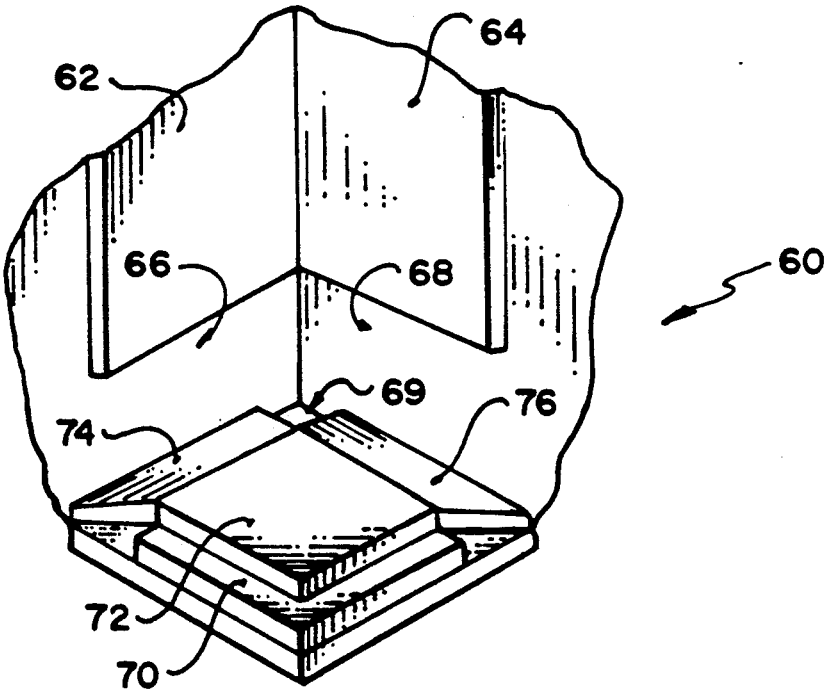
FIG. 3 is a fragmentary, top perspective view of the front portion of a bin according to an alternative embodiment of the invention.

FIG. 3 shows a bin 60, according to an alternative embodiment of the invention, having improved means for protecting corners of cards. Bin 60 has sides 62 and 64 having recesses 66 and 68 along the fronts thereof similar to the previous embodiment. There is also a recess 69 at the bottom of front 70 of the bin which in this case is generally square in shape. There is also a raised, square portion 72 on the front of the bin formed by an additional layer of corrugated plastic in this embodiment. This is above recess 69. There are inclined areas 74 and 76 which are generally rectangular and extend from the raised area 72 to each of the sides 62 and 64.

When cards are placed in the bin, the first card is placed on one of the sides, say side 64, so an edge of the card rests on side 62 and the front of the card initially rests on inclined area 76. It may be observed that the bottom, front corner of the card does not contact the bin, but rather is suspended between recesses 66, 68 and 69. Additional cards are piled on top of the first card and their corners continue to be above recess 69. The cards are gradually held further towards the back of the bin 60 by the inclined area 76 until the stack of cards is high enough so a card reaches raised area 72. However, although that card is then beyond recess 69, its corner is protected because it is then located over inclined area 74 which slopes away from raised area 72. The corners of subsequent cards are then protected as they are located within recess 66 and the recess located above inclined area 74. The cards can then be piled until they reach the full height of raised area 72 with full corner protection.

Sorter 10 illustrated in FIGS. 1 and 2 is generally rectangular in shape although the front, right hand corner has been cut off and replaced by a triangular shelf 80. Many other shapes and configurations of sorters are within the scope of the invention however.

In use the person using tray 10 normally stands or sits in front of it. The bins are angled downwardly towards the fronts thereof to be within easy reach, for efficient card sorting. The ten bins of this embodiment are preferred to optimize sorting speed. When sorting by, for example a three digit sports card number, three trays are used, one for each digit. Each tray has a bin labelled for each number zero to nine. There are no extra bins to confuse the user and each digit has the same layout. When laid side by side, the outline of each tray outlines the digit grouping. This contrasts with prior art trays having twenty or twenty-eight bins in a single tray, so there are not enough bins in one tray to sort by three digits and too many with more than one tray.

The invention not only protects the corners of cards better than prior art sorting trays, but permits easier, faster sorting and has a unique v-shaped tray instead of being rectangular as with prior art trays. This permits cards to be quickly dropped into the bins.

It will be understood by someone skilled in the art that many of the details specified above are by way of example only and can be altered without departing from the scope of the invention which is to be interpreted with reference to the following claims.

What is claimed is:

1. A sorting tray, comprising a plurality of adjacent bins, each of the bins having a front, a back and a bottom, the bins being V-shaped with inclined, flat, rectangular sides diverging upwardly from the bottoms thereof, the bins being angled downwardly towards the fronts thereof when the sorting tray is positioned for use, each bin having means for protecting corners of cards placed in each said bin, the means including a recess along each side of each bin adjacent to the front thereof, a recess in the front of each bin near the bottom thereof, a raised area on the front of each bin above the recess and inclined areas extending from the raised area to the sides of the bin on each side of the recess.

* * * * *